US006698111B2

(12) United States Patent
Lela

(10) Patent No.: US 6,698,111 B2
(45) Date of Patent: Mar. 2, 2004

(54) SNOW TRAIL GROOMING ACCESSORY AND METHOD

(76) Inventor: Gary J. Lela, 204 N. Richmond Ave., Westmont, IL (US) 60559

( * ) Notice: Subject to any disclaimer, the term of this patent is extended or adjusted under 35 U.S.C. 154(b) by 0 days.

(21) Appl. No.: 09/963,052

(22) Filed: Sep. 25, 2001

(65) Prior Publication Data

US 2003/0056402 A1 Mar. 27, 2003

(51) Int. Cl.[7] ..... E01H 4/02
(52) U.S. Cl. ..... 37/219; 37/231
(58) Field of Search ..... 37/219, 223, 224, 37/231; 172/799.5

(56) References Cited

U.S. PATENT DOCUMENTS

| | | | | | |
|---|---|---|---|---|---|
| 2,840,933 | A | * | 7/1958 | Brem | 37/404 |
| 3,106,969 | A | | 10/1963 | Carter | |
| 3,478,827 | A | | 11/1969 | Madson | |
| 3,496,843 | A | * | 2/1970 | Wallingford | 404/75 |
| 3,576,214 | A | | 4/1971 | Ratcliffe | |
| 3,652,106 | A | * | 3/1972 | Waterman | 280/405.1 |
| 3,666,020 | A | | 5/1972 | Hess | |
| 3,687,344 | A | | 8/1972 | Nixon | |
| 3,741,577 | A | | 6/1973 | Rude | |
| 3,779,572 | A | | 12/1973 | Cheney | |
| 3,795,069 | A | | 3/1974 | Cheney | |
| 3,872,931 | A | | 3/1975 | Camp | |
| 3,878,900 | A | | 4/1975 | Boisse et al. | |
| 3,884,498 | A | | 5/1975 | Cote, Jr. | |
| 3,915,239 | A | | 10/1975 | Henrichon | |
| RE29,356 | E | * | 8/1977 | Bennett | 299/25 |
| 4,051,614 | A | * | 10/1977 | Diggs | 37/409 |
| 4,057,916 | A | * | 11/1977 | Roemer | 37/223 |
| 4,058,913 | A | | 11/1977 | Esquilat | |
| 4,070,030 | A | | 1/1978 | Clark | |
| 4,110,919 | A | | 9/1978 | Henrichon | |
| 4,122,614 | A | | 10/1978 | Cheney | |
| 4,127,949 | A | | 12/1978 | Sabrowsky et al. | |
| 4,202,118 | A | | 5/1980 | Held | |
| 4,244,662 | A | | 1/1981 | Olson | |
| 4,337,586 | A | | 7/1982 | Buono | |
| 4,341,027 | A | | 7/1982 | Rohner | |
| 5,119,752 | A | | 6/1992 | Doherty | |
| 5,680,715 | A | | 10/1997 | Thiboutot et al. | |
| 6,026,600 | A | | 2/2000 | Lela | |
| 6,094,845 | A | | 8/2000 | Lela | |

* cited by examiner

*Primary Examiner*—Thomas B. Will
*Assistant Examiner*—Meredith Petravick

(57) ABSTRACT

The invention concerns a snow trail grooming accessory and method for use with an operating snowmobile to groom a snow trail during operation of the snowmobile. The accessory includes at least one mounting arm, the mounting arm being mountable directly to a track suspension of the snowmobile; and a snow collector/leveler secured to the mounting arm wherein when the mounting arm is mounted to the operating snowmobile the mounting arm and the snow collector/leveler are pulled behind the snowmobile with the snow collector/leveler substantially skimming over a level portion of the snow trail and the snow collector/leveler impacting at least a portion of a snow mound, a snow mogul or a snow displacement in the snow trail.

51 Claims, 9 Drawing Sheets

SNOW TRAIL GROOMING ACCESSORY AND METHOD

FIELD OF THE INVENTION

The present invention relates generally to a snow trail grooming accessory for use with a snowmobile. More specifically, the invention concerns a trail grooming accessory for use with an operating snowmobile to prevent the initial formation of snow moguls, snow mounds and the like, and also, to aid in leveling a snow trail affected by existing snow moguls, snow mounds and the like.

BACKGROUND OF THE INVENTION

Various snow trail grooming devices exist in the art. Many of the known prior devices resemble towable sled devices hitched behind a vehicle for towing over a snow trail to groom the same. These devices are designed for use with personal motor craft (e.g., a snowmobile and the like) and industrial type towing vehicles. Of these, only the devices for use with a personal motor craft vehicle are intended for towing behind a snowmobile under operating conditions, i.e., at operating speeds while traveling over a snow trail. These devices can serve their intended purpose rather well, especially when one desires to tow a load of articles behind the vehicle while also performing snow grooming. However, when one does not desire to tow such a device behind their vehicle but still desires to conduct snow trail grooming while operating the vehicle, a more compact and economical trail grooming device is needed.

As appreciated by one of ordinary skill in the art, and moreover by the average snowmobile operator, most snowmobiles are driven by a centrally located track which comes into contact with a ground surface (e.g., usually snow), over which the snowmobile travels. During operation of the snowmobile, and particularly upon commencing forward travel, the snow engaging portion of the track moves from the front of the snowmobile to the back of the snowmobile. The track lifts some of the snow it contacts and displaces or sprays it backwards to a back track location where the track looses contact with the snow covered surface upon initial forward movement. As a result of the snow displacement or spray effect, a pile of snow is usually deposited just behind the position where the back end of the snowmobile was located.

If this pile is left alone, it merely represents a mound of snow in the snowmobile path or trail. If this pile is traveled over by other snowmobiles it is compacted and eventually forms a mogul or the like. In either case, this pile of snow creates a disturbance in the snowmobile trail. Such a disturbance is sometimes desirable to provide a more challenging snowmobile ride. However, even just one of these disturbances can make operating a snowmobile difficult given the unlevel or uneven snow surface on the snow trail. Furthermore, when considering a popular snow trail, it is evident that over a period of time and with many snowmobiles traveling over the same trail, the snow mound or snow mogul effect will be multiplied and the difficulty or lack of comfort to the snowmobile operator could become quite significant.

To a somewhat lesser degree, but still significant and particularly so depending on snow moisture conditions, during operation of the snowmobile over a snow trail, a snow spray is continuously propelled outward and upward from the back of the snowmobile, but not usually at a constant rate. The amount of snow spray depends on the speed of the snowmobile and the snow moisture conditions. Thus, in the ordinary course of operating the snowmobile, simply changing speeds can, regardless of moisture conditions, vary the amount of snow sprayed whereby any positive differential amount will cause a snow mound, and in due course over time a mogul or the like.

One way to deal with the snow mounds, snow moguls and the like is to remove them well after they have formed, i.e., with equipment that is proposed by some prior art devices. Such an approach is commendable, however, it can ignore the bigger part of the problem, namely, the creation of snow mounds, snow moguls and the like in the first place. Furthermore, with some prior art devices, although they remove the snow mounds, moguls and the like, solving one problem, such action often creates another problem. Over a short period of time, employing merely a device or method that removes the trail disturbance well after its formation tends to form a snow trail rut where the prior art device has scraped over the snow trail and pushed the loose snow off or out of the sides of the device. As is obvious in geographic locations where there is not a steady supply of new snow or a substantial snow base, such a scrapping action significantly displacing the snow trail snow would destroy a snowmobile trail in a short period of time.

Accordingly, a more compact and economical trail grooming accessory, which can be directly attached to a snowmobile, is needed. Further, such a device will desirably include the features of enabling trail grooming while operating the snowmobile, in order to prevent the initial formation of snow mounds, moguls and the like, and with minimal disturbance to the natural snow covered condition of the snow trail.

SUMMARY OF THE INVENTION

In one aspect of the invention, I have provided a snow trail grooming accessory for use with an operating snowmobile to groom a snow trail during operation of the snowmobile. The snow trail grooming accessory includes at least one mounting arm, the mounting arm being mountable directly to a track suspension of the snowmobile. The accessory also includes a snow collector/leveler secured to the mounting arm wherein when the mounting arm is mounted to the operating snowmobile the mounting arm and the snow collector/leveler are pulled behind the snowmobile with the snow collector/leveler substantially skimming over a level portion of the snow trail and the snow collector/leveler impacting at least a portion of a snow mound, a snow mogul or a snow displacement in the snow trail.

In another aspect of the inventions, I have provided a snow trail grooming accessory for use with an operating snowmobile to groom a snow trail during operation of the snowmobile. The snow trail grooming accessory includes at least one mounting arm, the mounting arm being mountable directly to a track suspension of the snowmobile and being substantially fixed in position relative to the track suspension when mounted thereto. The accessory also includes a snow collector/leveler secured to the mounting arm wherein when the mounting arm is mounted to the operating snowmobile the mounting arm and the snow collector/leveler are pulled behind the snowmobile with the snow collector/leveler substantially skimming over a level portion of the snow trail and the snow collector/leveler impacting at least a portion of a snow mound, a snow mogul or a snow displacement in the snow trail.

In still another aspect of the invention I have provided a snow trail grooming accessory for use with an operating snowmobile to groom a snow trail during operation of the snowmobile. The snow trail grooming accessory includes a snow collector/leveler mountable to the snowmobile, the snow collector/leveler includes a tubular shell defining a temporary retention chamber therein which is adapted to receive snow from the operating snowmobile or a snow trail through at least one opening in communication with the temporary retention chamber. The temporary retention chamber includes a portion that is substantially bounded by a circumference of the tubular shell and the temporary retention chamber having a longitudinal axis wherein the temporary retention chamber is oriented in a non-parallel direction as defined by the longitudinal axis relative to a longitudinal axis of the snowmobile.

In yet another aspect of the invention, I have provided a method for grooming a snow trail with an operating snowmobile. The method includes mounting a snow trail grooming accessory directly to a track suspension of the snowmobile; and pulling the snow trail grooming accessory behind the operating snowmobile wherein the snow trail grooming accessory substantially skims over a level portion of the snow trail and the snow trail grooming accessory impacts at least a portion of a snow mound, a snow mogul or a snow displacement in the snow trail.

In still other aspects of the invention, I have provided a pair of mounting arms which mount the snow collector/leveler to the snowmobile, a cross member for mounting the snow collector/leveler to the snowmobile, and various configurations and characteristics of the snow collector/leveler.

In accordance with the following, the present invention advantageously provides a way of slicing up snow mounds, snow moguls and the like, immediately upon formation, with a compact grooming accessory mountable to an operating snowmobile. The invention may advantageously pull or draw snow trail disturbances forward into crevices or valleys where the snow trail surface is of a lower height than the average snow trail surface of a snowmobile trail, thereby smoothing out bumpy snow surfaces while traversing a snowmobile trail. The invention may advantageously at least partially deflect a portion of a snow spray or displacement of an operating snowmobile moving over a snowmobile trail. The invention may advantageously provide a snow trail grooming accessory that enables the snowmobile to be conventionally operated in a forward or reverse direction of travel and loaded on to and off of a towing trailer without having to adjust or remove the snow trail grooming accessory from the snowmobile.

These and other features and advantages of my invention will become more readily apparent upon reference to the following description when taken in conjunction with the accompanying drawings, which drawings illustrate several aspects of my invention.

DETAILED DESCRIPTION OF THE PREFERRED EMBODIMENT

Figure 1:
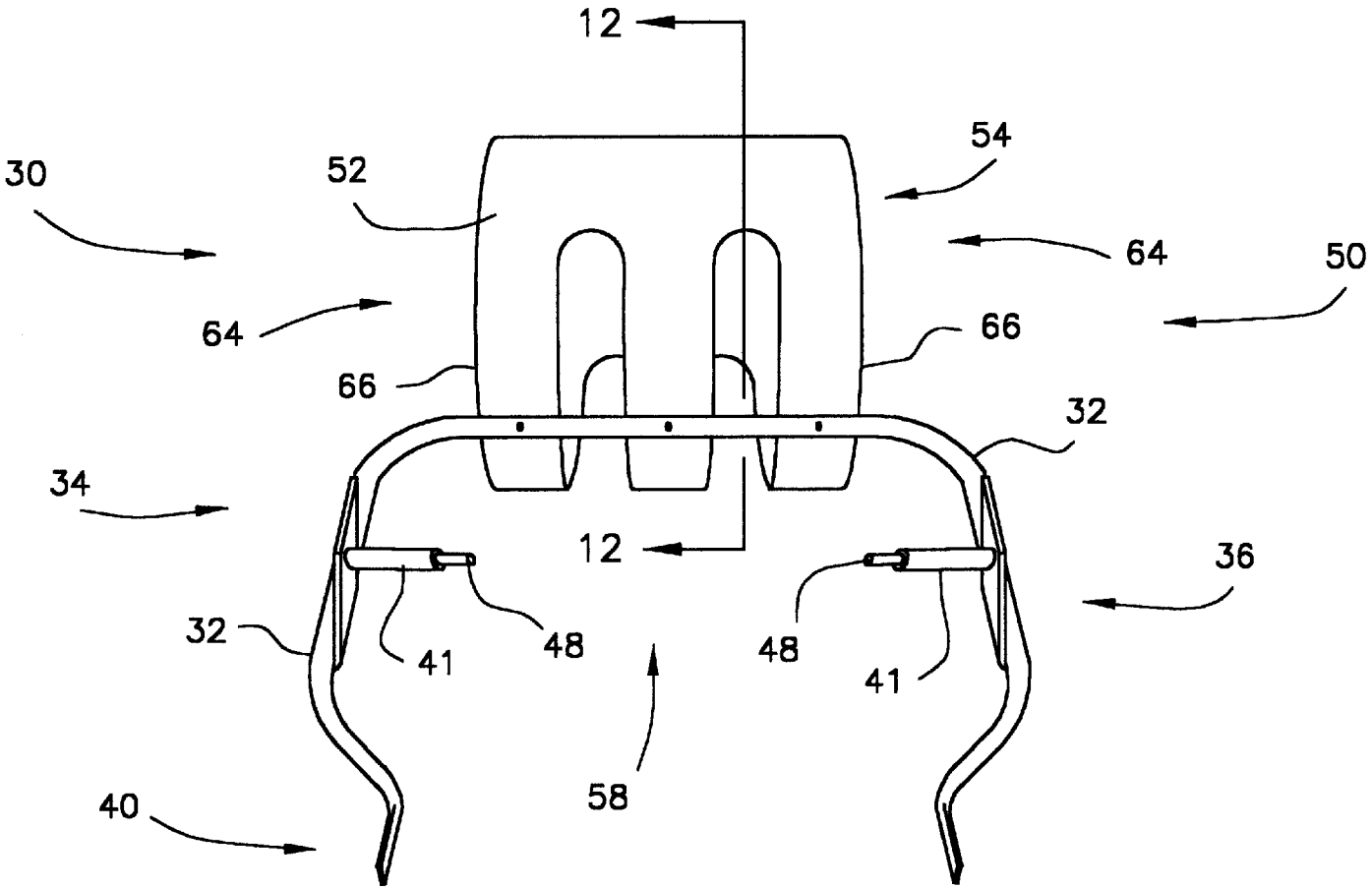
FIG. 1 is a front top perspective view of a snow trail grooming accessory in accordance with the teaching of the invention.

Referring generally to the drawings, and particularly FIGS. 1 and 4 to 6 for example, there is seen a snow trail grooming accessory 30 for use with a snowmobile 10 to groom a snow trail 100 during operation of the snowmobile. The snowmobile 10, or operating snowmobile 10 during operation of the same, can be most any conventional snowmobile. As such, snowmobiles 10 have a track suspension 12 which includes, among other components, a track slide rail 14, a rear idler wheel 18 proximate a back end 20 of the snowmobile, and a track 22 of the snowmobile for assisting in propelling the snowmobile. The track 22 has a bottom surface 24 (i.e., a constantly changing rotating surface during operation of the snowmobile) which engages the snow trail 100 and generally defines a horizontal plane relative to a level portion 102 of the snow trail except when there may be a snow trail disturbance 104 as discussed hereafter. On either side of the snowmobile are seen opposite sides 16 of the track suspension. A longitudinal axis 26 of the snowmobile extends from its front end to its back end 20. During operation, the operating snowmobile 10 can travel in a forward direction 28 or an opposite reverse direction 29.

A tunnel assembly 13 is located over the suspension 12. The assembly 13 includes, among other components, a rider's seat and rear bumper and snow flap. Tunnel assembly 13 is maintained in place over the suspension 12 by, at least in part, a suspension spring system (not shown). A relationship between the suspension spring system and the rider's seat and rear bumper contributes to snowmobile handling characteristics and rider comfort for the snowmobile. That is, the spring suspension system is dependent upon, at least in part, the weight and distribution thereof for the rider's seat and rear bumper to determine certain snowmobile handling characteristics and rider comfort. Thus, changes in the weight, or distribution of weight, by the rider's seat and rear bumper can alter the snowmobile handling characteristics and rider comfort, and often times dramatically alter this relationship beyond specification ranges intended or desired by the snowmobile manufacturer. Additionally, this can contribute to the advantage of a snow trail grooming accessory being mounted to the track suspension which tends to be greatly in contact with the snow trail (i.e., and thus so will the accessory mounted thereto), as opposed to the grooming accessory being mounted to the tunnel assembly which is normally in constant flux of height relative to the snow trail during operation of the snowmobile.

Figure 2:
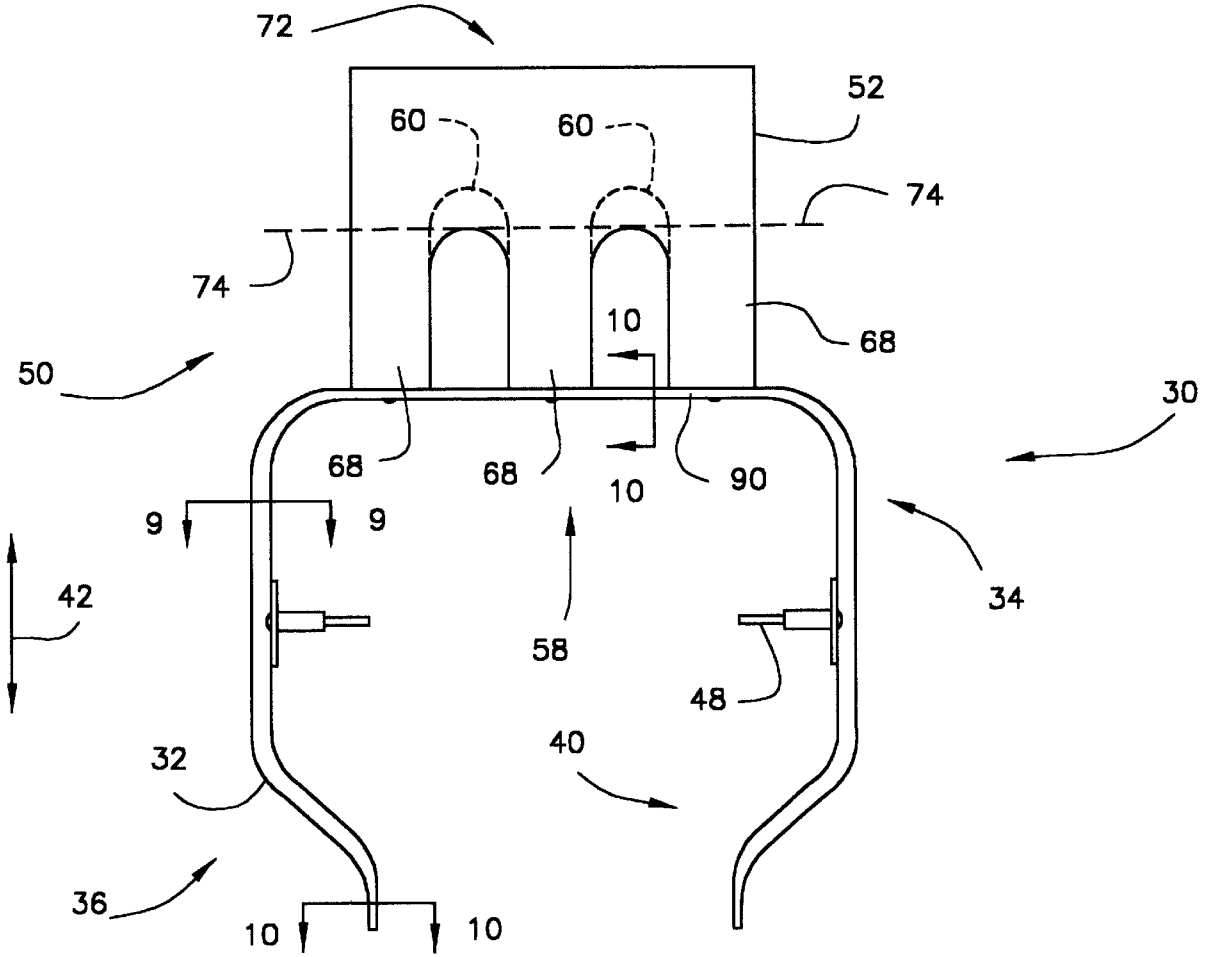
FIG. 2 is a top view of the accessory of FIG. 1.
Figure 3:
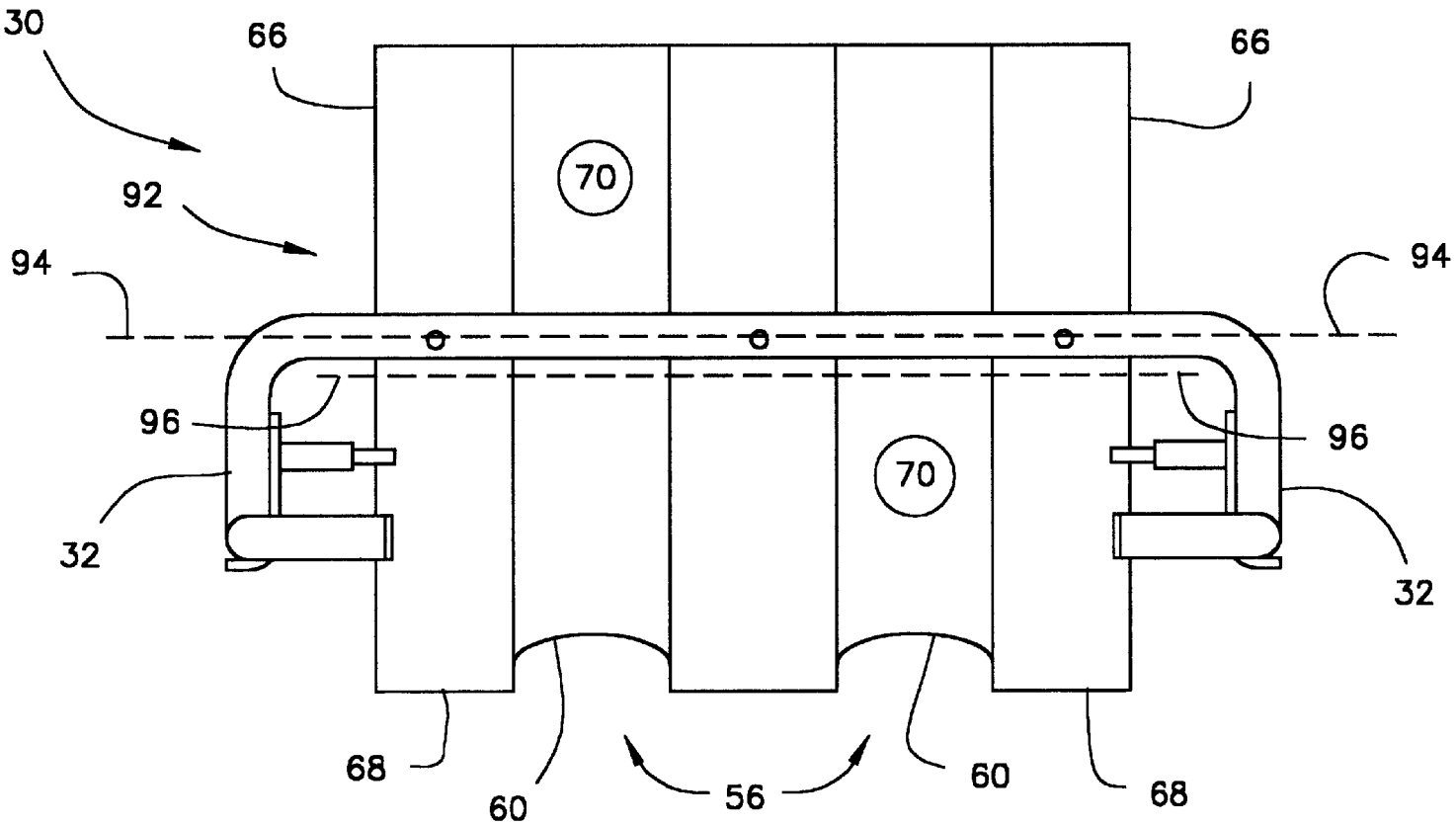
FIG. 3 is a front view of an accessory of the invention similar to that of FIG. 1.

Referring to all the figures, and particularly FIGS. 1 to 3, the snow trail grooming accessory 30 can include at least one mounting arm 32, where the mounting arm 32 is mountable directly to the track suspension 12 of the snowmobile. In one aspect of the invention, this advantageously provides the height and position of the mounting arm(s) 32, relative to the snow trail 100, being controlled by only those parts of the snowmobile in contact with the snow trail surface, namely, the track suspension 12. Without being limited to a theory of operation, this is believed to be beneficial for on-the-move snow trail disturbance elimination at the time of creation of the disturbance. In another aspect of the invention, this advantageously maintains normal snowmobile handling characteristics and rider comfort for the snowmobile even when the grooming accessory 30 is mounted to the operating snowmobile 10 because accessory 30 is not mounted to the rider's seat or rear bumper or in other ways does not interfere with the spring suspension system.

More particularly, the arm 32 can be mounted to the track slide rail 14, for example, at an end portion or second end portion 36 by way of any suitable mechanical fastening relationship 48 (e.g., bolt, screw, pin, rivet, etc. into slide rail 14 or welding or bonding to slide rail 14). Alternatively or additionally, arm 32 can be mountable to the track suspension 12 at the rear idler wheel 18 at the end portion 36 of the mounting arm, also by any suitable mechanical fastening relationship 48 (e.g., bolt, screw, pin, rivet, etc. into idler wheel 18 or welding or bonding to idler wheel 18). When the arm(s) 32 is mounted to the idler wheel 18 and the slide rail 14 (or other component fixed relative to the position of idler wheel 14 or vice versa), the arm(s) can be mounted to the track slide rail 14 at a distal end portion 40. Thereby, the end portion 36 and the distal end portion 40 can be spaced apart and thus the pair of mounting arms can be fixedly mountable relative to the track suspension 12 (i.e., and because the idler wheel 18 is fixed relative to slide rail 14 except for rotational movement of the idler wheel 18 relative to the slide rail). With any of these mountings to the track suspension, it may often be desirable to space the arm 32 from the idler wheel 18, track 22 and any other moving parts of the propulsion system, to prevent interference between the arm 32 and these components during operation of the snowmobile (e.g., by use of any conventional spacer 41 between the inside surface of the arm 32 and the idler wheel 18, which space can desirably be between about ½ inch (1.25 cm) and about 1½ inches (3.75 cm). The mounting arm can be permanently mounted to the track assembly or removably (i.e., semi-permanently) mounted to the track assembly, each by conventional techniques or those discussed herein.

Figure 9:
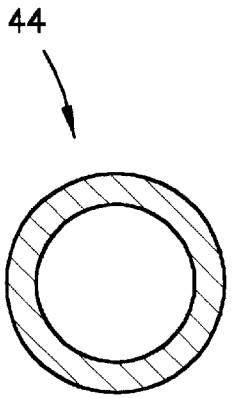
FIG. 9 is cross sectional view of a portion of the mounting arm taken along the line 9—9 of FIG. 2.

The mounting arm 32 can, advantageously, be a pair of mounting arms 32 that are near identical except a mirror image of each other. With such a pair of arms, each can be mounted directly to opposite sides 16 of the track suspension 12. A cross member 90 can be positioned between the second end portion 36 of each arm 32. The cross member can be formed separate from the arm 32 and joined thereto or formed together with the arm 32. The cross member can serve to fix the second end portions 36 of each arm 32, as well as secure the snow collector/leveler 50. The mounting arm 32 can have a tubular cross-sectional dimension 44 (FIGS. 2 and 9), a flat cross-sectional dimension 46 (FIGS. 2, 7, 10 and 11), a hollow or solid core to either dimension 44 or 46, or any other dimension that assists in providing the advantageous rigid features of the arm 32. In this regard, the arm 32 can be made of any of a variety of materials as long as they provide a relatively rigid, stiff characteristic along a longitudinal axis 42 of the arm, and an at least semi-rigid to rigid characteristic along a horizontal axis (i.e., perpendicular to axis 42 and extending between arms 32). The cross member 90 can also have rigid characteristics along its length similar to the arm 32, and could similarly have the tubular cross-sectional dimension, the flat cross-sectional dimension, the hollow or solid core to either dimension, or any other dimension that assists in providing the advantageous rigid features of the cross member 90.

The arm(s) can have a first end portion 34 spaced from the second end portion 36. The snow collector/leveler 50 can be securable to the first end portion 34 and the end portion or second end portion being mountable to the track suspension 12 as discussed above. More particularly, the snow collector/leveler 50 can be secured to the first end portion by, e.g., attachment with cross member 90 by any suitable mechanical fastening relationship (e.g., bolt, screw, pin, rivet, etc. into cross member 90 or welding or bonding to member 90, and with or without washers as desired) or forming therewith. Arm(s) 32 can have a projecting portion (e.g., upward or downward) at second send portion or end portion 36 as desired for positioning the snow collector/leveler as taught herein.

Another aspect of the invention concerns the snow collector/leveler 50 also for use with the operating snowmobile 10 to groom the snow trail 100 during operation of the snowmobile. Collector/leveler 50 is configured to both collect snow from the snow trail for temporary retention therein and to level portions of the snow trail (e.g., snow trail disturbances), during operation of the snowmobile. The snow collector/leveler is mountable to the snowmobile, e.g., through use of the mounting arm(s) 32 taught herein or other techniques known in the art (such as those discussed in U.S. Pat. No. 6,026,600 of Lela or U.S. Pat. No. 6,094,845 of Lela or art discussed in these two patents, all which is incorporated herein by reference). The snow collector/leveler includes a tubular shell 52 which defines a temporary retention chamber 54 therein. Shell 52 could be of most any tubular shape, e.g., cylindrical, triangular, square, pentagonal to hexagonal, etc., as long as the shell is oriented to avoid positioning any corner(s) against the snow trail which could significantly plow snow in the snow trail rather than substantially skim over the snow trail surface. The shell can be made from a variety of materials as long as they have one or more of the characteristics that may be desired as taught herein. For example, a conventional five gallon bucket made of high density polyethylene (HDPE) could be used. For similar reasons, it is believed that this and other plastics having a thickness in the range of about 2 mm to about 4 mm could be used to make the collector/leveler 50.

Figure 12:
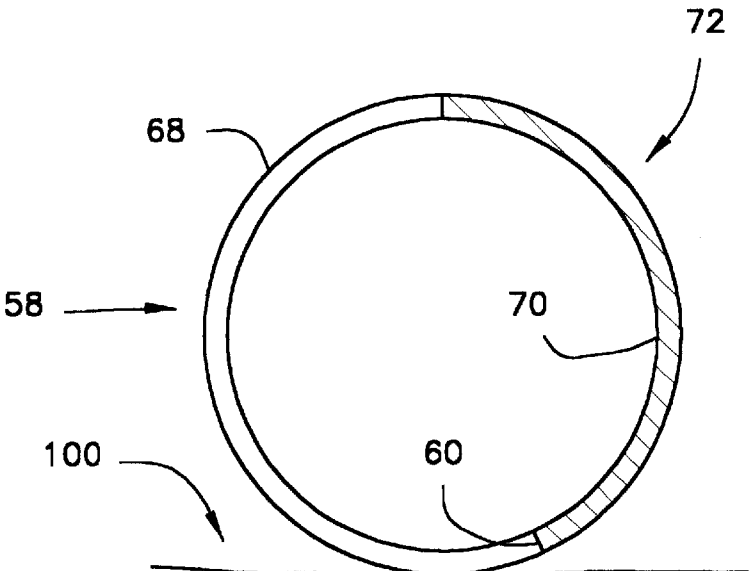
FIG. 12 is cross sectional view of a portion of the snow collector/leveler taken along the line 12—12 of FIG. 1.
Figure 11:
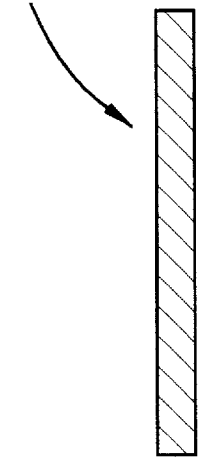
FIG. 11 is cross sectional view of a portion of the mounting arm taken along the line 11—11 of FIG. 7.
Figure 10:
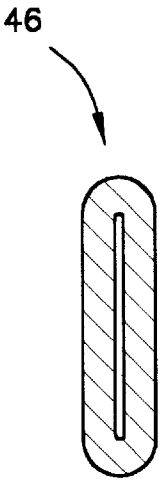
FIG. 10 is cross sectional view of two different portions of the mounting arm taken along the lines 10—10 of FIG. 2.

The chamber 54 is adapted to receive snow from the operating snowmobile or the snow trail through at least one opening in communication with the temporary retention chamber. The at least one opening can be located in a front portion 58 of the tubular shell such as openings 56 or located in an end 66 of the tubular shell and advantageously both opposite ends such as second openings 64. Each opening is in communication with the temporary retention chamber 54. The opening(s) 56 can have a lower edge 60 (FIGS. 1 and 12, e.g.) which terminates in a range from before to after a tangent line 62 formed relative to the tubular shell and the snow trail, and advantageously before or after tangent line 62. The tubular shell also includes a closed surface 70 located at a back portion 72 of the tubular shell.

The chamber 54 includes a portion that is substantially bounded by a circumference of the tubular shell, for example, any of ribs 68 in combination with adjoining back portion 72 circumferentially therewith. The temporary retention chamber has a longitudinal axis 74 which is oriented in a non-parallel direction, and advantageously close or equal to substantially perpendicular, as defined by the longitudinal axis relative to the longitudinal axis 26 of the snowmobile. Each of the at least one opening, the closed surface and the longitudinal orientation, alone and in combinations, contribute at least in part to a portion of the snow from the operating snowmobile or the snow trail being temporarily retained in the chamber and redirected upon exit therefrom rather than passing straight through the chamber if the chamber were in parallel with the longitudinal axis of the snowmobile.

The desired width of the snow collector/leveler is generally about the same as or less than a width of the snowmobile track 16, because it is the spin of the track and snow spray therefrom which causes the formation of a snow trail disturbance 104 (e.g., a snow displacement or spray, a snow mound, or snow mogul). The desired outside diameter of the snow collector/leveler, for analogous reasons, is generally about the same size as or less than a height of the track suspension. For example, for a Polaris™ 1994 year, model Trail Touring snowmobile, the width of the snow collector/leveler can be in the range of about 12 inches (30 cm) for a snowmobile track width of about 15 inches (37.5 cm)(e.g., centering the collector/leveler relative to the track width and using three ribs 68 each about two inches wide with two openings 56 each about three inches wide). More importantly, for example, the width of the collector/leveler can be in the range of about 50% to about 125% of the width of the track of the snowmobile. The outside diameter of the snow collector/leveler can be in the range of about 6 inches to about 18 inches (15 cm to 45 cm), depending on the type and lug style of the snowmobile track.

When employing a plurality of openings 56 in the front portion 58, each opening 56 is preferably spaced from each adjacent opening 56 by rib 68 or similar structure. In this way, the portion of the circumference of the tubular shell located within the front portion 58 of the tubular shell serves to deflect at least a portion of the snowmobile snow spray or displacement in a downward direction while allowing a portion to pass through the opening(s) adjacent thereto and into chamber 54. As such, this arrangement enables the snow collector/leveler to displace forward a portion of a snow mound, a snow mogul or a snow spray or displacement, without displacing forward all of the same and likely causing an undesirable snow trail rut over time, or causing undue strain on the collector/leveler when encountering a snow trail hazard.

Figure 4:
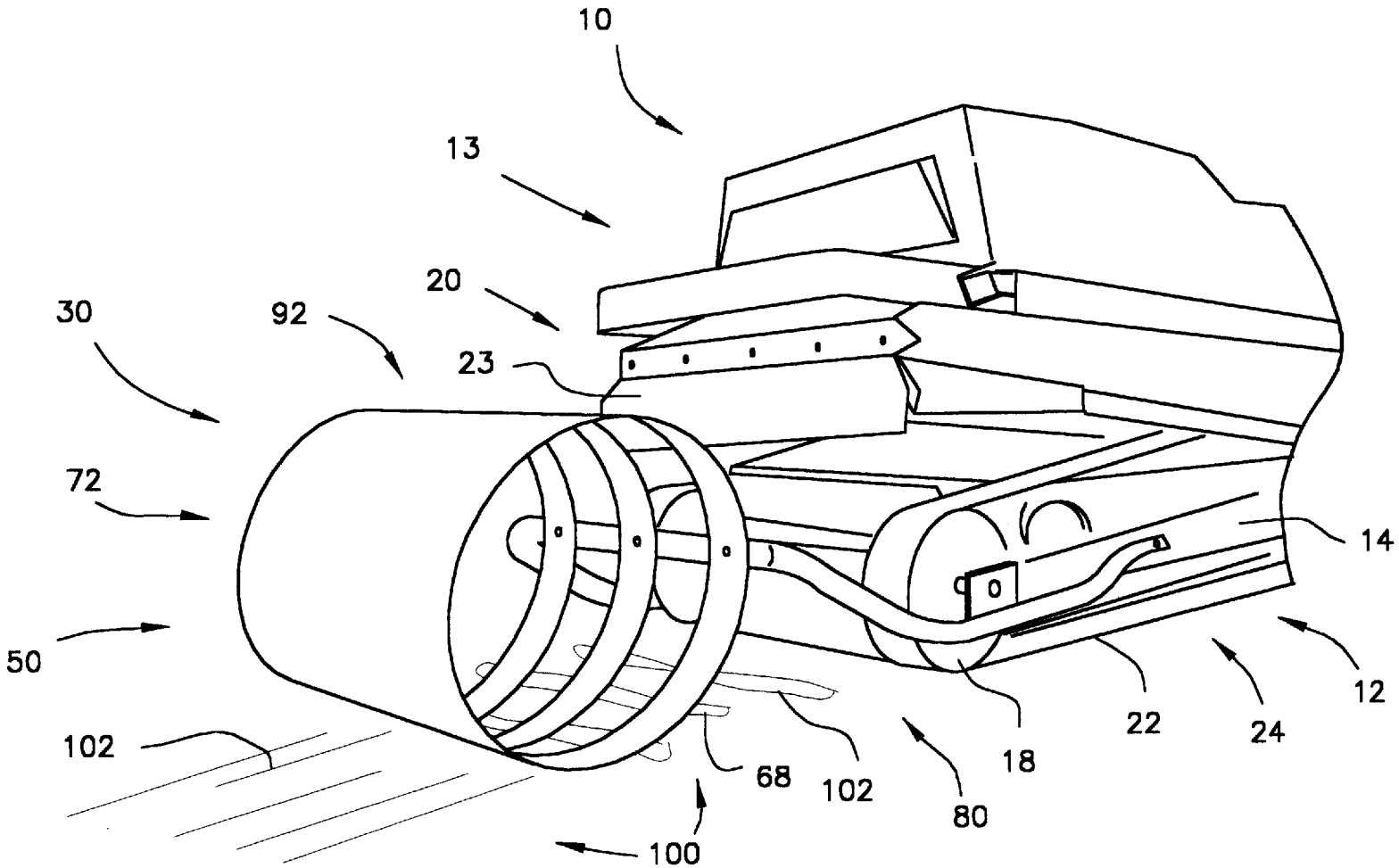
FIG. 4 is a back right side view of the accessory of FIG. 3, but now mounted to a snowmobile.

In one aspect of the invention, when the snow collector/leveler is securable to the cross member it can be located in an offset position 92 relative to the cross member (FIGS. 3 and 4, e.g.). Such an offset position is defined as any location in the tubular shell 52 where there is more of the circumference of the shell above than below, and vice versa, a horizontal axis 94 including cross member 90. Stated another way, position 92 is any location in the tubular shell that is above or below horizontal axis 96 which includes the cross-sectional center of tubular shell 52. Particularly, for example, the offset position can be located above the axis 96, such as position 92, so that more than half of the circumference of the shell 52 extends below cross member 90. In this way, a downward force 86 can be imparted upon the back portion 72 by the mere distribution of weight of the shell 52 relative to the cross member 90 (i.e., more weight below axis 94 than above it). Additional ways the downward force 86 can be imparted upon the collector/leveler 50 can include the use of springs, rubber members, or torsion arms, each mounted between the collector/leveler and either the cross member 90 or arm(s) 32.

Figure 8A:
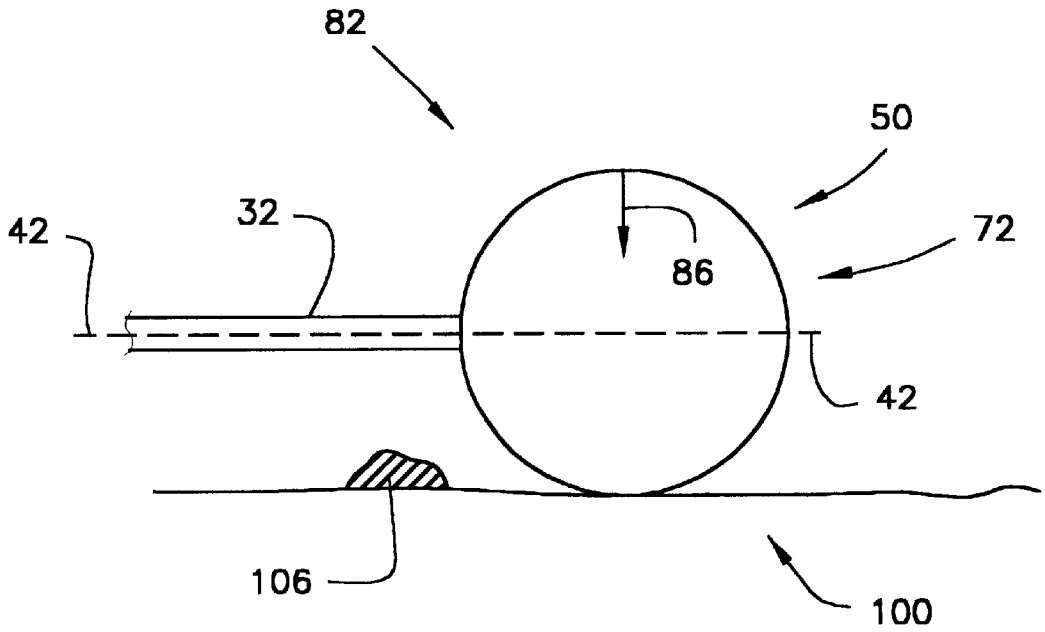
FIG. 8A is a schematic side view of a portion of the accessory of the invention in a home position before impacting a snow trail disturbance or snow trail hazard.
Figure 8B:
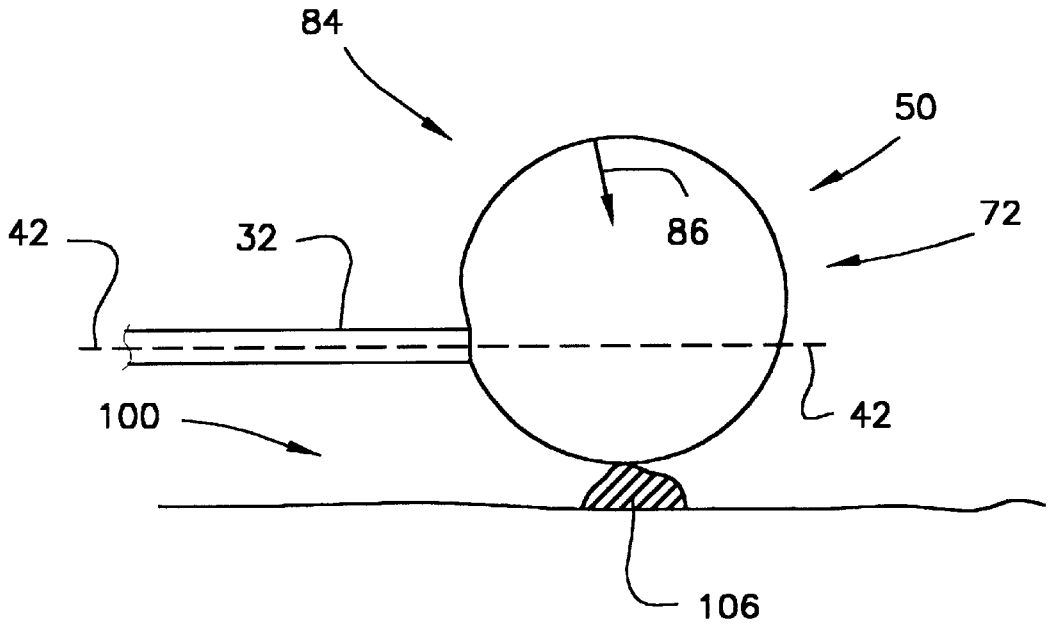
FIG. 8B is a schematic side view of a portion of the accessory of the invention in a deflected position upon impacting a snow trail hazard.

In another aspect of the invention, and referring to FIGS. 8A and 8B, which aspect can complement or be independent of, the offset position 92, when the snow collector/leveler is securable to the cross member the snow collector/leveler can have a flexible/resilient characteristic which allows a portion of the snow collector/leveler 50 to pivot relative to the cross member 90. Additionally, or alternatively, it can be advantageous for the collector/leveler to also pivot between a home position 82 and a deflected position 84 relative to a horizontal plane defined by the bottom surface 24 of the track 22 of the snowmobile. Additionally, or alternatively, and depending on whether the collector/leveler is mounted to the arm(s) directly or to the cross member which is secured to the arm(s), the collector/leveler 50 may be able to pivot relative to the longitudinal axis 42 of the mounting arm. For example, FIGS. 8A and 8B show the collector/leveler pivoting relative to the substantially fixed longitudinal axis 42 of the mounting arm (i.e., and thus also the cross member secured thereto) as the collector impacts a snow trail hazard 106. The deflected position can be advantageous to avoid or mitigate the effect of the hazardous snow trail disturbance 106 such as a rock, tree limb or other relatively fixed ground structure, as well as excessively large snow trail disturbances. Additionally, or alternatively, it may be advantageous for the snow collector/leveler to have a memory characteristic which maintains the snow collector/leveler in the home position when the snow collector/leveler is not impacting at least the portion of the snow mound, the snow mogul or the snow displacement in the snow trail. Additionally, or alternatively, it may be advantageous for the snow collector/leveler to include an at least partially downward force, such as force 86 and by the same or similar techniques discussed previously, when the snow collector/leveler is in the home 82 position and when the snow collector/leveler is in the deflected position 84. When in the home position, such a downward force can assist in maintaining the collector/leveler in contact with the snow trail surface, for example. When in the deflected position, such a downward force can assist in returning the collector/leveler to the home position, for example.

The flexible/resilient characteristic and the memory characteristic can be obtained by various techniques. The flexible/resilient characteristic defines the snow collector/leveler being both flexible and resilient. The memory characteristic defines the collector/leveler as being able to return to a substantially same first position after being moved from the first position by some force. Each of these characteristics can be obtained by, e.g., construction of the tubular shell out of plastic, rubber, or materials or composite materials with properties that allow for retaining shape and durability even when subject to being hit and battered by a snow trail disturbance and particularly a snow trail hazard. Other ways to obtain these characteristics can include the use of springs, rubber members, or torsion arms, each mounted between the collector/leveler and either the cross member 90 or arm(s) 32; or a combination of any of these or other similar techniques.

The offset position 92 of the snow collector/leveler 50 provides additional mass at the bottom portion of the collector/leveler 50 that is nearest the snow trail 100 and assists the collector/leveler 50 in breaking up a snow trail disturbance upon impacting the same. Also, the upward projection of the bottom portion of the tubular shell 52 away from the snow trail enables the collector/leveler 50 (i.e., the whole accessory 30) to be moved in a reverse direction 29 of travel, without having to specially manipulate the accessory 30 or detach the same from the snowmobile, when operating the snowmobile in the reverse direction 29 or when loading the snowmobile on to or off of a towing trailer.

To varying degrees, each of the just discussed features of the collector/leveler 50 concerning offset positioning, the flexible/resilient characteristic, pivoting between the home and deflected positions, the memory characteristic, and the downward force, can advantageously assist the snow collector/leveler, and thus the grooming accessory 30, in on-the-move (i.e., with an operating snowmobile) snow trail grooming to prevent the initial formation of snow moguls, snow mounds and the like, and also, to aid in leveling a snow trail affected by existing snow moguls, snow mounds and the like.

Figure 5:
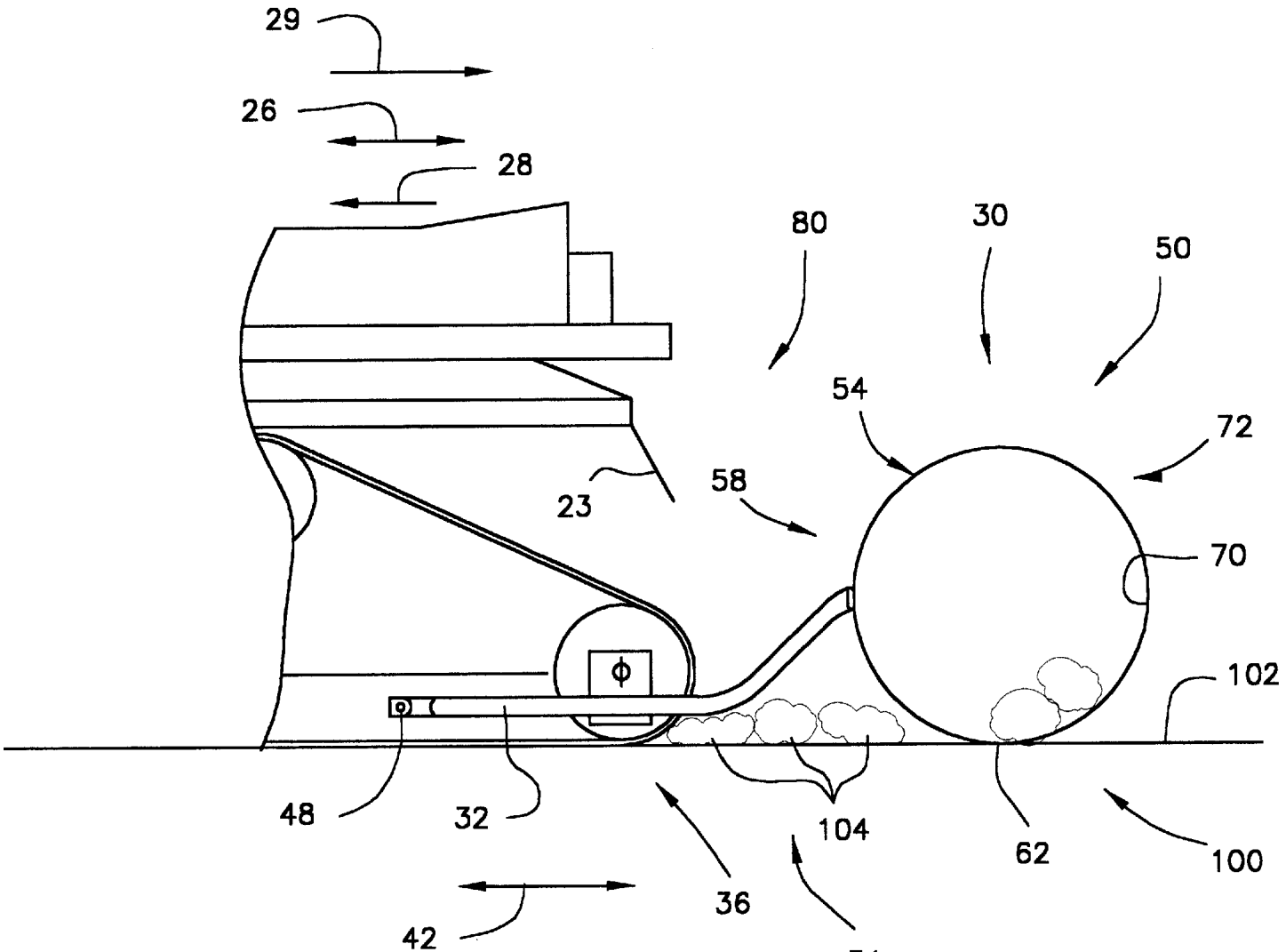
FIG. 5 is a back left side view of the accessory of FIG. 1, but now mounted to a snowmobile.
Figure 6:
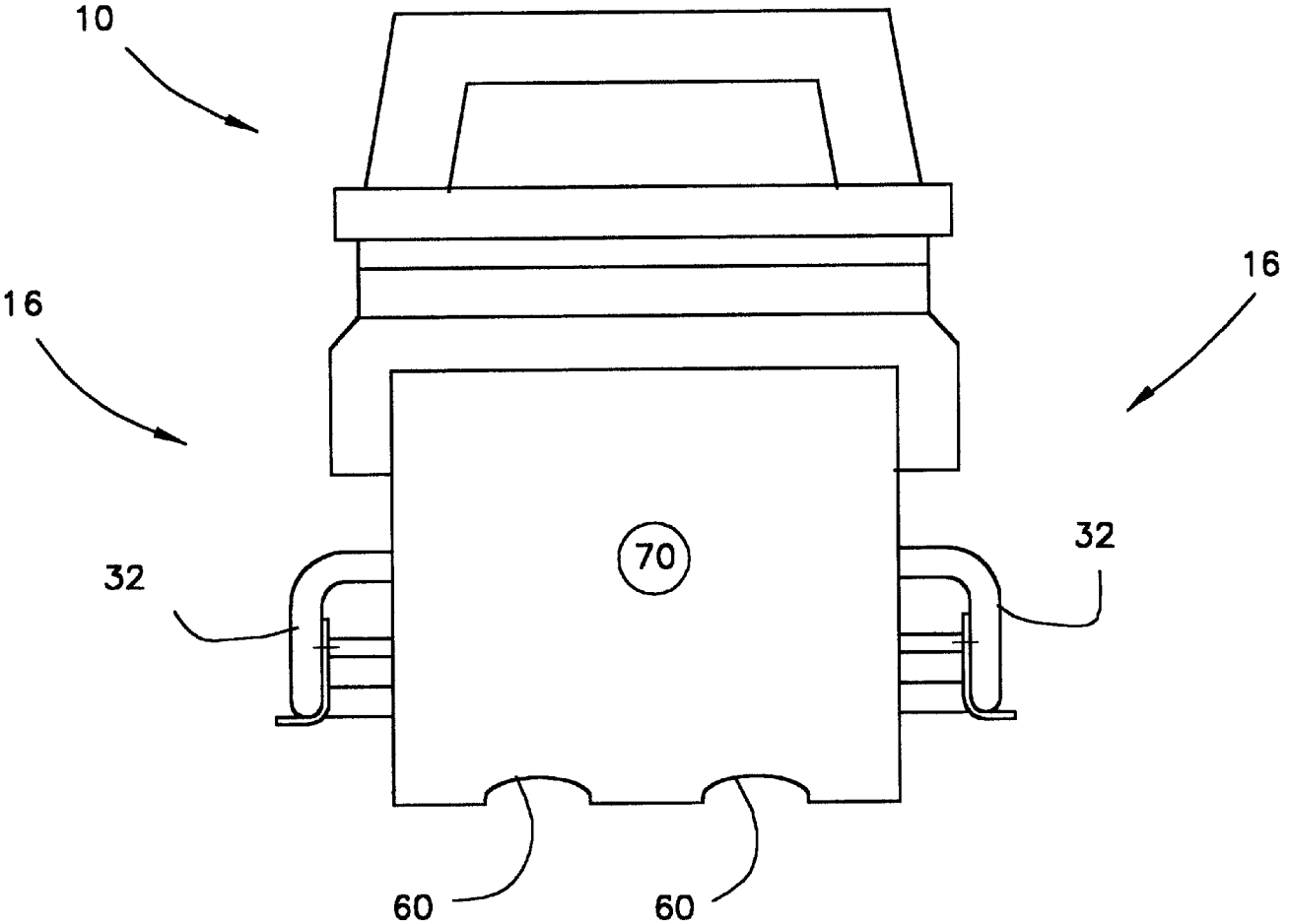
FIG. 6 is a back view of the accessory of FIG. 4.
Figure 7:
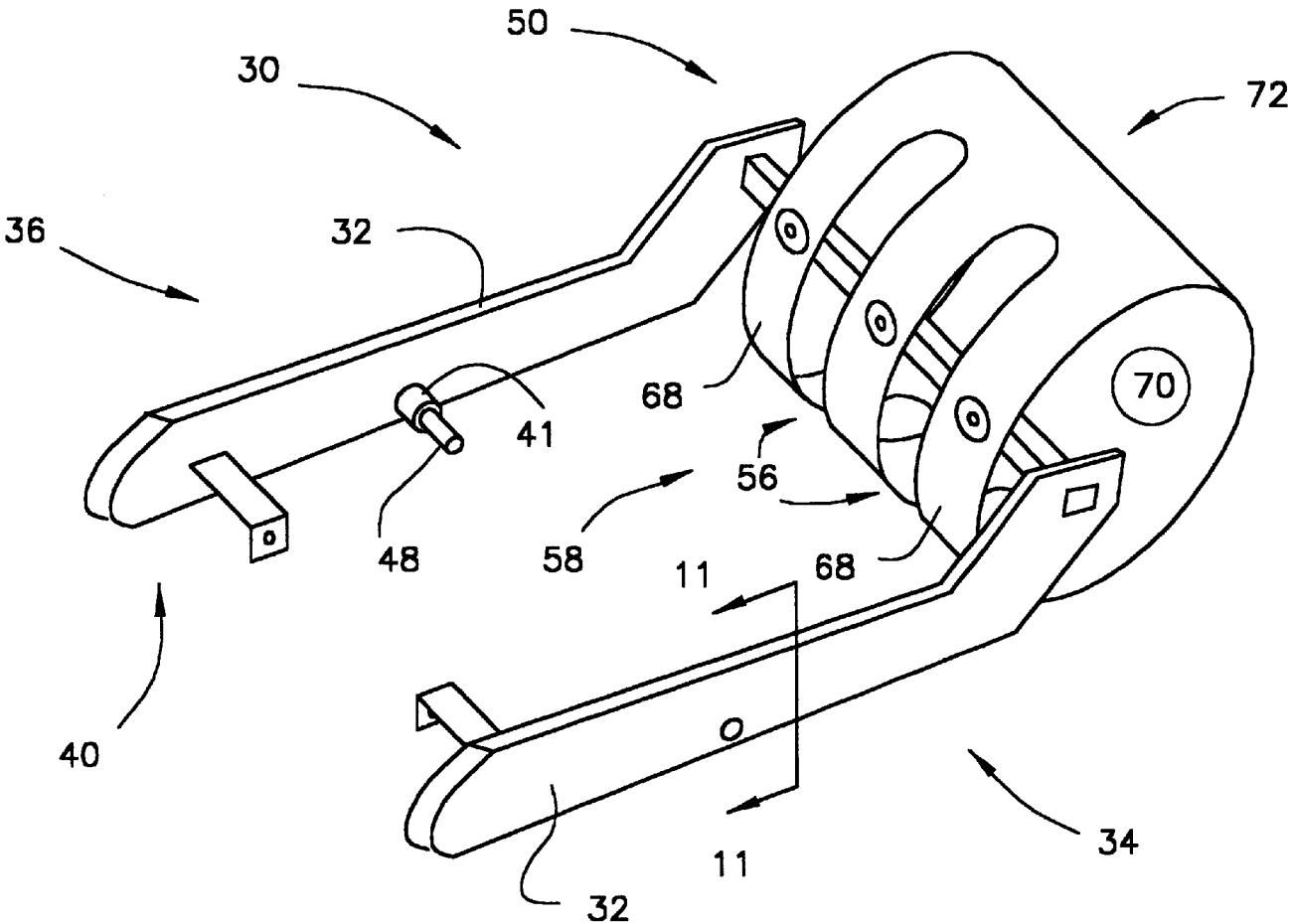
FIG. 7 is a front top perspective view of another snow trail grooming accessory in accordance with the teaching of the invention.

In operation, e.g., referring to FIGS. 4 to 6, the snow collector/leveler 50 is secured to the mounting arm which in turn is mounted to the operating snowmobile. As such, the mounting arm and the snow collector/leveler are pulled behind the snowmobile with the snow collector/leveler substantially skimming over (e.g., advantageously between about one inch (1 cm) above and below the trail surface, more advantageously between about one-half inch (1.25 cm) above and below the trail surface, still more advantageously between about one-quarter inch (0.625 cm) above and below the trail surface, yet more advantageously about even to less than about one-half inch (1.25 cm) above the trail surface) the level portion of the snow trail and the snow collector/leveler impacting at least the portion of the snow trail disturbance (e.g., snow mound, the snow mogul or the snow displacement). Advantageously, the snow collector/leveler is mounted behind the snowmobile so there is a space 80 completely separating the collector/leveler 50 from the back end 20 of the snowmobile (i.e., the back most part of the tunnel assembly or back of the track, whichever is closer to the collector/leveler). Space 80 can be in the range of, and in increasing degrees of advantage, between about 24 inches (60 cm) to about 1 inch (2.5 cm), between about 18 inches (45 cm) to about 2 inches (5 cm), and between about 12 inches (30 cm) to about 3 inches (7.5 cm). Also, depending on the size of the space and the snowmobile, the snow flap may need to be modified or removed to allow the snow spray to effectively communicate with the collector/leveler or prevent undesirable interference between the snow flap and the grooming accessory.

For example, as the track 22 spins it causes excessive snow spray to discharge from under it where it contacts the adjacent snow trail 100. Some of the excessive spray is immediately bounced sideways and downward off the ribs 68 of the collector/leveler 50 and back onto the snow trail. Some of the excessive spray enters the chamber through opening(s) 56 and is temporarily retained in chamber 54 at a first time and then released out opening(s) 64 or 56 at a subsequent time during operation of the snowmobile. Additionally, some volume of snow from the snow trail or a snow trail disturbance can be scooped up through opening (s) 56 and also temporarily retained in chamber 54 at a first time and then released out opening(s) 64 or 56 at a subsequent time during operation of the snowmobile. As the snow volume increases in the collector/leveler, it is forced out the opening(s) 64 or 56 in the collector/leveler at a regulated rate during normal operation of the snowmobile, thereby eliminating large piles of snow left on the snow trail surface. For example, as the snowmobile travels forward and the collector/leveler vibrates due to normal shaking of the track suspension system, snow in the temporary retention chamber gradually disperses along the snow trail.

In yet another aspect, the invention relates to a method for grooming snow trail 100 with operating snowmobile, e.g., snowmobile 10. Steps for the method are now discussed in no particular order, except advantageous orders for certain steps may be mentioned relative to one another without limiting that particular ordering. The method includes mounting a snow trail grooming accessory, e.g., accessory 30 or through use of another structure with similar function, directly to the track suspension 12 of the snowmobile. The method also includes, and advantageous next, pulling the snow trail grooming accessory behind the operating snowmobile such that the snow trail grooming accessory substantially skims over the level portion 102 of the snow trail 100 and the snow trail grooming accessory impacts at least a portion of the snow trail disturbance 104 (e.g., snow mound, snow mogul or snow displacement).

The method can further include maintaining the snow trail grooming accessory in a substantially fixed position relative to the track suspension, e.g., by use of arm (s) 32 in one or more manner discussed previously or through use of another structure with similar function. Advantageously, mounting can be mounting a pair of mounting arms, e.g., arms 32 or use of another structure with similar function, to opposite sides of the track suspension, and can also include securing a snow collector/leveler, e.g., collector/leveler 50 or use of another structure with similar function, to the mounting arms. Still more advantageously, mounting can include positioning a cross member, e.g., member 90 or use of another structure with similar function, between the mounting arms and securing the snow collector/leveler to the cross member.

The method can then further include maintaining the snow trail grooming accessory in a substantially fixed position relative to the track suspension and maintaining a space, e.g., space 80, completely between the snow collector/leveler and the back end 20 of the snowmobile. Still further, the method can then include temporarily retaining at least a portion of the snow spray produced by the operating snowmobile 10 at a first time and then releasing at least the portion of the snow spray out at least one end, e.g., end(s) 66, of the snow collector/leveler at a subsequent time during operation of the snowmobile. Yet further, the method can include pivoting the snow collector/leveler between a home position, e.g., position 82, and a deflected position, e.g., position 84, relative to a horizontal plane defined by the bottom surface 24 of the track 22 of the snowmobile. These steps of the method can be, and when done are, performed for reasons analogous to those discussed previously for similar structures of the invention.

All components of the invention, unless specifically limited previously, can be constructed of a rigid material, such as steel, aluminum, plastic, hard rubber, etc. Further, it is believed that all such components of the invention can be constructed of a rust resistant rigid metal material (e.g., galvanized steel) or have a rust resistant coating to enhance the durability and longevity of the components.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

I claim:

1. A snow trail grooming accessory in combination with an operating centrally located track driven personal recreational snowmobile to groom a snow trail during operation of the operating centrally located track driven personal recreational snowmobile, comprising:

the snowmobile and at least one mounting arm, the mounting arm being mounted directly to a track suspension of the operating centrally located track driven personal recreational snowmobile; and a snow collector/leveler secured to the mounting arm wherein the mounting arm is mounted to the operating centrally located track driven personal recreational snowmobile such that the mounting arm and the snow collector/leveler are pulled behind the operating centrally located track driven personal recreational snowmobile with the snow collector/leveler substantially skimming over a level portion of the snow trail and the snow collector/leveler impacting at least a portion of a snow mound, a snow mogul or a snow displacement in the snow trail during operation of the operating centrally located track driven personal recreational snowmobile as at least one of the snow mound, the snow mogul or the snow displacement is formed.

2. The accessory of claim 1 wherein the mounting arm is mountable to a track slide rail of the track suspension.

3. The accessory of claim 1 wherein the mounting comprises a pair of mounting arms, the pair of mounting arms being mountable directly to opposite sides of the track suspension.

4. The accessory of claim 3 wherein each of the pair of mounting arms has a first end portion and a second end portion and the snow collector/leveler is securable to the first end portion and the second end portion is mountable to the track suspension.

5. The accessory of claim 4 further comprising a cross member positioned between the second end portion of each of the pair of mounting arms.

6. The accessory of claim 5 wherein the snow collector/leveler is securable to the cross member and is located in an offset position relative to the cross member.

7. The accessory of claim 5 wherein the snow collector/leveler is securable to the cross member and the snow collector/leveler has a flexible/resilient characteristic which allows a portion of the snow collector/leveler to pivot relative to the cross member.

8. The accessory of claim 1 wherein when the snow collector/leveler is mounted behind the snow mobile there is a space completely separating the snow collector/leveler from a back end of the snowmobile.

9. The accessory of claim 8 wherein the snow collector/leveler is configured to temporarily retain at least a portion of a snow spray produced by the operating snowmobile at a first time and then release at least the portion of the snow spray out at least one opening of the snow collector/leveler at a subsequent time during operation of the snowmobile.

10. A snow trail grooming accessory in combination with an operating snowmobile to groom a snow trail during operation of the snowmobile, comprising:

the snowmobile and at least one mounting arm, the mounting arm being mounted directly to a track suspension of the snowmobile and being substantially fixed in position relative to the track suspension when mounted thereto; and a snow collector/leveler secured to the mounting arm wherein the mounting arm is mounted to the operating snowmobile such that the mounting arm and the snow collector/leveler are pulled behind the snowmobile with the snow collector/leveler substantially skimming over a level portion of the snow trail and the snow collector/leveler impacts at least a portion of a snow mound, a snow mogul or a snow displacement in the snow trail.

11. The accessory of claim 10 wherein the mounting arm comprises a pair of mounting arms, the pair of mounting arms being mountable directly to opposite sides of the track suspension.

12. The accessory of claim 11 wherein the pair of mounting arms are mountable to a rear idler wheel of the track suspension at an end portion of each of the pair of mounting arms.

13. The accessory of claim 12 wherein the pair of mounting arms are mountable to a track slide rail of the track suspension at a distal end portion of each of the pair of mounting arms and where the end portion and the distal end portion are spaced apart and thereby the pair of mounting arms are fixedly mountable relative to the track suspension.

14. The accessory of claim 10 wherein the mounting arm has a tubular cross-sectional dimension or a flat cross-sectional dimension.

15. The accessory of claim 10 wherein the snow collector/leveler has a flexible/resilient characteristic which allows a portion of the snow collector/leveler to pivot relative to a longitudinal axis of the mounting arm.

16. The accessory of claim 15 wherein the snow collector/leveler can pivot between a home position and a deflected position relative to a horizontal plane defined by a bottom surface of a track of the snowmobile.

17. The accessory of claim 16 wherein the snow collector/leveler has a memory characteristic which maintains the snow collector/leveler in the home position when the snow collector/leveler is not impacting at least the portion of the snow mound, the snow mogul or the snow displacement in the snow trail.

18. The accessory of claim 16 wherein the snow collector/leveler comprises an at least partially downward force when the snow collector/leveler is in the home position and when the snow collector/leveler is in the deflected position.

19. The accessory of claim 10 wherein the mounting arm is removably mounted to the track assembly.

20. A snow trail grooming accessory for use with an operating snowmobile to groom a snow trail during operation of the snowmobile, comprising:

a snow collector/leveler mountable to the snowmobile, the snow collector/leveler comprising a tubular shell defining a temporary retention chamber therein which is adapted to receive snow from the operating snowmobile or the snow trail through at least one opening in communication with the temporary retention chamber and wherein the tubular shell is fixedly mounted for no axial rotation; and, the temporary retention chamber comprising a portion that is substantially bounded by a circumference of the tubular shell and the temporary retention chamber having a longitudinal axis wherein the temporary retention chamber is oriented in a non-parallel direction as defined by the longitudinal axis relative to a longitudinal axis of the snowmobile.

21. The accessory of claim 20 wherein the at least one opening is located in a front portion of the tubular shell opposing a track of the snowmobile when the snow collector/leveler is mounted to the snowmobile.

22. The accessory of claim 21 wherein the opening is located in an end of the tubular shell.

23. The accessory of claim 21 wherein the tubular shell comprises at least a second opening in communication with the temporary retention chamber and the second opening is located in an end of the tubular shell.

24. The accessory of claim 20 wherein the at least one opening is located in a front portion of the tubular shell opposing a track of the snowmobile when the snow collector/leveler is mounted to the snowmobile and the tubular shell has opposite open ends also in communication with the temporary retention chamber.

25. The accessory of claim 20 wherein the at least one opening has a lower edge which terminates before or after a tangent line formed relative to the tubular shell and the snow trail.

26. The accessory of claim 20 wherein the tubular shell comprises a closed surface located at a back portion of the tubular shell.

27. The accessory of claim 23 wherein the tubular shell comprises a closed surface located at a back portion of the tubular shell.

28. The accessory of claim 24 wherein the tubular shell comprises a closed surface located at a back portion of the tubular shell.

29. The accessory of claim 20 wherein the temporary retention chamber is oriented in a substantially perpendicular direction as defined by the longitudinal axis relative to the longitudinal axis of the snowmobile.

30. The accessory of claim 20 wherein the snow collector/leveler is mountable directly to a track suspension of the snowmobile wherein when the snow collector/leveler is mounted to the operating snowmobile the snow collector/leveler substantially skims over a level portion of the snow trail and the snow collector/leveler impacts at least a portion of a snow mound, a snow mogul or a snow displacement in the snow trail.

31. The accessory of claim 30 further comprising a pair of mounting arms and each of the pair of mounting arms having a first end portion and a second end portion wherein the snow collector/leveler is secured to the first end portion and the second end portion is mountable to the track suspension.

32. The accessory of claim 31 further comprising a cross member positioned between the second end portion of each of the pair of mounting arms and the snow collector/leveler is secured to the cross member.

33. The accessory of claim 20 wherein the snow collector/leveler is mountable directly to a track suspension of the snowmobile and the snow collector/leveler is substantially fixed in position relative to the track suspension when mounted thereto and wherein when the snow collector/leveler is so mounted the operating snowmobile pulls the snow collector/leveler to substantially skim over a level portion of the snow trail and to impact at least a portion of a snow mound, a snow mogul or a snow displacement in the snow trail.

34. The accessory of claim 33 further comprising a pair of mounting arms, the pair of mounting arms being mountable directly to opposite sides of the track suspension at an end portion of each of the pair of mounting arms and wherein the pair of mounting arms are mountable to a track slide rail of the track suspension at a distal end portion of each of the pair of mounting arms with the end portion and the distal end portion being spaced apart and thereby the pair of mounting arms being fixedly mountable relative to the track suspension.

35. The accessory of claim 34 wherein the snow collector/leveler can pivot between a home position and a deflected position relative to a horizontal plane defined by a bottom surface of a track of the snowmobile.

36. The accessory of claim 35 wherein the snow collector/leveler has a memory characteristic which maintains the snow collector/leveler in the home position when the snow collector/leveler is not impacting at least the portion of the snow mound, the snow mogul or the snow displacement in the snow trail.

37. The accessory of claim 20 further comprising:

at least one mounting arm mountable directly to a track suspension of the snowmobile wherein when the mounting arm is so mounted the operating snowmobile pulls the snow collector/leveler over a level portion of the snow trail and the snow collector/leveler impacts at least a portion of a snow mound, a snow mogul or a snow displacement in the snow trail; and the mounting arm has a first end portion and a second end portion, the snow collector/leveler being securable to the first end portion and the second end portion being mountable to the track suspension.

38. The accessory of claim 37 further comprising a cross member located at the second end portion of the mounting arm and the snow collector/leveler is secured to the cross member.

39. The accessory of claim 37 further comprising a cross member located at the first end portion of the at least one mounting arm and the snow collector/leveler is securable to the cross member wherein the mounting arm and the snow collector/leveler are substantially fixed relative to the track suspension except for pivoting of the collector/leveler relative to the track suspension.

40. The accessory of claim 37 wherein the snow collector/leveler can pivot between a home position and a deflected position relative to a horizontal plane defined by a bottom surface of a track of the snowmobile and snow collector/leveler has a memory characteristic which maintains the snow collector/leveler in the home position when the snow collector/leveler is not impacting at least the portion of the snow mound, the snow mogul or the snow displacement in the snow trail.

41. A method for grooming a snow trail with an operating snowmobile, comprising:

mounting a snow trail grooming accessory directly to a track suspension of the snowmobile; and pulling the snow trail grooming accessory behind the operating snowmobile wherein the snow trail grooming accessory substantially skims over a level portion of the snow trail and the snow trail grooming accessory impacts at least a portion of a snow mound, a snow mogul or a snow displacement in the snow trail.

42. The method of claim 41 further comprising maintaining the snow trail grooming accessory in a substantially fixed position relative to the track suspension.

43. The method of claim 41 wherein mounting comprises mounting a pair of mounting arms to opposite sides of the track suspension.

44. The method of claim 43 wherein mounting comprises securing a snow collector/leveler to the mounting arms.

45. The method of claim 44 wherein mounting comprises positioning a cross member between the mounting arms and securing the snow collector/leveler to the cross member.

46. The method of claim 44 further comprising maintaining the snow trail grooming accessory in a substantially fixed position relative to the track suspension and maintaining a space completely between the snow collector/leveler and a back end of the snowmobile.

47. The method of claim 44 further comprising temporarily retaining at least a portion of a snow spray produced by the operating snowmobile at a first time and then releasing at least the portion of the snow spray out at least one opening of the snow collector/leveler at a subsequent time during operation of the snowmobile.

48. The method of claim 44 further comprising pivoting the snow collector/leveler between a home position and a deflected position relative to a horizontal plane defined by a bottom surface of a track of the snowmobile.

49. The method of claim 41 further comprising operating the snowmobile in a forward or a reverse direction without having to adjust or remove the snow trail grooming accessory from its mounting to the track suspension.

50. A snow trail grooming accessory in combination with an operating snowmobile, comprising:

the snowmobile and means for mounting the snow trail grooming accessory directly to a track suspension of the snowmobile, wherein the means for mounting is mounted directly to the track suspension; and means for grooming a snow trail during operation of the snowmobile wherein the means for grooming is secured to the means for mounting and the means for grooming is fixedly mounted for no axial rotation during snow trail grooming.

51. The accessory of claim 50 wherein the grooming accessory is substantially fixed in position relative to the track suspension when mounted thereto.

* * * * *